US005112064A

United States Patent [19]

Weedman

[11] Patent Number: 5,112,064

[45] **Date of Patent: * May 12, 1992**

[54] PSYCHOLOGY GAME

[76] Inventor: Gail H. Weedman, 607 Tumbleweed Ct., Kokomo, Ind. 46901

[ * ] Notice: The portion of the term of this patent subsequent to Jun. 4, 2008 has been disclaimed.

[21] Appl. No.: 631,088

[22] Filed: Dec. 19, 1990

Related U.S. Application Data

[63] Continuation-in-part of Ser. No. 537,915, Jun. 13, 1990, Pat. No. 5,020,804.

[51] Int. Cl.[5] ..... A63F 9/18; G09B 19/00

[52] U.S. Cl. ..... 273/429; 434/236; 273/459

[58] Field of Search ..... 273/249, 248, 243, 296, 273/236, 429, 459; 434/236

[56] References Cited

U.S. PATENT DOCUMENTS

| | | | |
|---|---|---|---|
| 3,124,358 | 3/1964 | Weedman | 273/249 |
| 4,682,956 | 7/1987 | Krane | 273/243 |
| 4,872,681 | 10/1989 | Martin | 273/118 R |
| 4,893,819 | 1/1990 | Wright | 273/243 |

FOREIGN PATENT DOCUMENTS

| | | | |
|---|---|---|---|
| 2126908 | 4/1984 | United Kingdom | 273/236 |

*Primary Examiner*—Benjamin Layno
*Attorney, Agent, or Firm*—Woodard, Emhardt, Naughton Moriarty & McNett

[57] ABSTRACT

A psychology game particularly adapted for play through publication in a newspaper or other periodical. Players are provided with a hypothetical person having a plurality of disclosed character traits, a description of a circumstance with which the hypothetical person is confronted, a plurality of descriptions of possible reactions of the hypothetical person to the circumstance, and an answer list for determining the accuracy of the player's reaction selection. The game is played by selecting as most appropriate one of the plurality of descriptions of possible reactions and then determining the accuracy of the player's reaction selection. In one variation, the hypothetical person is also assigned an undisclosed character trait which the player tries to determine by comparing the player's reaction selection to the answer list.

9 Claims, 1 Drawing Sheet

JOAN'S CHARACTER PROFILE

Joan is 12 years old, rather pretty, independent, self-reliant, a little selfish, uninhibited and loves her mother.

SITUATION

Joan and her mother are in the kitchen when her stepfather comes home from the office. Mr. Stevens kisses his wife of four weeks and hands Joan an unexpected gift as he says, "Joan, we are getting along quite well. You can call me dad." How would Joan react? Read Joan's character profile carefully before selecting the two most likely and least likely reactions.

JOAN'S CHARACTER PROFILE

Joan is 12 years old, rather pretty, independent, self-reliant, a little selfish, uninhibited and loves her mother.

SITUATION

Joan and her mother are in the kitchen when her stepfather comes home from the office. Mr. Stevens kisses his wife of four weeks and hands Joan an unexpected gift as he says, "Joan, we are getting along quite well. You can call me dad." How would Joan react? Read Joan's character profile carefully before selecting the two most likely and least likely reactions.

Fig. 1

PSYCHOLOGY GAME

REFERENCE TO RELATED APPLICATIONS

This application is a continuation-in-part of U.S. Pat. Application Ser. No. 537,915 filed June 13, 1990 entitled IMPROVED PSYCHOLOGY GAME now U.S. Pat. No. 5,020,804.

BACKGROUND OF THE INVENTION

This invention relates generally to a method of playing a psychology game.

Games involving the use of psychological skills are known in the prior art. For example, my U.S. Pat. No. 3,124,358 discloses a psychology game in which players try to select the most appropriate reaction of a hypothetical person to a given circumstance from a plurality of different given reactions to the given circumstance and therefore acquire for that selection the most advantageous game value. The appropriateness of the various possible given reactions are predetermined on the basis of the friendliness of the hypothetical person.

The above game assigns ratings to the various responses on the basis whether the hypothetical person is friendly or unfriendly. This feature of the above game is somewhat restrictive however in that there exists a wide variety of physical, mental, emotional, social and moral character traits that affect a person's psychological development and accordingly influence that person's reactions to various circumstances.

Another aspect of the game disclosed in the above patent is that the character trait assigned to the hypothetical person is disclosed at the outset of the game so that such character trait may help the players determine the most appropriate reaction of the hypothetical person to the given circumstance. In my patent application Ser. No. 537,915, I described an improved version of the psychology game disclosed in the above patent wherein certain character traits of the hypothetical person are left unknown for the players to discover. This feature provides an additional challenge making the game more fun and exciting. However, while the improved version of my psychology game can be played by as few as one individual, it is perceived that the educational and learning benefits associated with the psychology game format could be provided to a much greater audience by creating a variation of the game which is particularly suitable for play such as through publication in a regularly run newspaper column.

SUMMARY OF THE INVENTION

One embodiment of the present invention involves a method of playing a psychology game wherein the player or players are provided a description of a hypothetical person having a plurality of disclosed character traits, a description of a circumstance with which the hypothetical person is confronted, and a plurality of descriptions of possible reactions of the hypothetical person to the circumstance. The player selects as most appropriate at least one of the plurality of descriptions of possible reactions to the selected circumstance and determines the accuracy of the player's reaction selection by comparing the player's reaction selection to an answer list rating the plurality of descriptions of possible reactions based upon the likelihood of the particular response being made by the hypothetical person to the circumstance.

One object of the present invention is to provide an improved psychology game.

A further object of the present invention is to provide a psychology game which uses situation ethics as a tool to instill values into persons such as children and promote an exchange of ideas about values among adults.

Another object of the present invention is to provide a psychology game which is particularly adapted for play through publication in a newspaper or other periodical.

Other objects and benefits of the present invention can be discerned from the following written description.

BRIEF DESCRIPTION OF THE DRAWINGS

FIG. 1 is a fragmentary schematic representation of the more simplified version of the game of the present invention shown printed in a newspaper column.

DESCRIPTION OF THE PREFERRED EMBODIMENT

For the purposes of promoting an understanding of the Principles of the invention, reference will now be made to the preferred embodiment and specific language will be used to describe the same. It will nevertheless be understood that no limitation of the scope of the invention is thereby intended, such alterations and further modifications in the illustrated methods, and such further applications of the principles of the invention as illustrated therein being contemplated as would normally occur to one skilled in the art to which the invention relates.

In a first variation, the subject game is provided for play through publication in a newspaper column or magazine. In the column, a hypothetical person is described as having a plurality of disclosed character traits, i.e., friendly, outgoing, extrovert, laughs spontaneously, acts negatively to criticism, sharing, etc. and at least one undisclosed character trait. A representative example of a disclosed character profile for a hypothetical person named Mary is described as follows:

PROFILE OF MARY

Mary is 17 years old, intelligent, strong-willed, opinionated, an individualist, (unknown trait), rather indifferent to her brother and sister but tolerates them.

In addition to the description of the hypothetical person there is described a hypothetical circumstance or situation with which the hypothetical person is confronted. The hypothetical circumstance can take innummerable forms, as an example however, the circumstance may be designed to present a situation involving a moral or ethical problem or dilemma. A useful purpose for employing such a circumstance would be to use situation ethics as a tool in the context of a fun-to-play game format to teach and provoke discussion concerning community values. An exemplary situation or circumstance such as might be described for the hypothetical person Mary profiled above is as follows:

SITUATION #1

Mary was asked to babysit for her younger brother, Jeff, age 9 and her sister Susan, age 12. Mary is doing her homework in her room when she hears loud voices. When she enters the family room, Jeff has his hand on the TV channel control as Susan shouts, "Don't change the channel." How would Mary react? What would be Mary's second most likely reaction? Read the profile of Mary carefully before selecting the two most likely and the two least likely reactions for each from those listed.

Following the description of the hypothetical circumstance, a listing of possible reactions by the hypothetical person is presented. The number of possible reactions which are listed is to some degree a matter of choice depending upon various factors such as the degree of difficulty desired, publication space limitations, etc. In the following representative listing ten possible reactions are set forth:

REACTIONS OF MARY

1. Becomes angry and sends both to their rooms.
2. Quietly turns the TV to another channel and begins watching the program.
3. Says, "I hope you are having fun" and watches them work it out.
4. Turns off the TV and says, "Now what are you going to do?"
5. Ignores them both.
6. Feels discouraged.
7. Shakes Susan.
8. Feels embarrassed.
9. Tells Jeff to turn on his program.
10. Yells at them both.

After the player has made the reaction selections, they are compared to an answer list. The answer list is compiled by an expert or a panel of experts who preferably are professional psychologists, but may alternatively be a guest contributor, such as a civic leader or other types of well known personalities whose opinion on the subject would stimulate reader interest. The preparer of the answer list will have evaluated the various physical, mental, emotional, social and moral character traits which have been assigned to the hypothetical person and determined the appropriateness of each of a plurality of responses of the hypothetical persons to a given circumstance. A representative sample of an answer list to the previously described hypothetical person and situation is as follows:

ANSWER: Most likely—1 and 10. Least likely—3 and 8. Before continuing, analyze and reflect on the answers and try to determine Mary's unknown trait.

To prevent unintended reading of the answers before a player's response selections are made, the answer list can be published up side down or in a different part of the newspaper.

Of course, because there is one unknown character trait, the answers given may not seem entirely appropriate to the player. However, analysis and comparison of the player's answers with the answers provided in the answer list help the player to try and determine Mary's unknown trait. This becomes important in aiding the player's ability to predict the correct answers in succeeding situations as will soon become apparent.

After the player has completed his or her analysis of the answer list, the player next proceeds to review a second situation, a representative sample of which is set forth below:

SITUATION #2

While baby sitting, Mary is lying on the floor listening to the TV as she finishes her homework when Susan age 12 and Jeff, age 9, enter the room. Susan immediately flips the TV control to another channel. How would Mary react? Read Mary's profile and select the two most appropriate and two least appropriate responses.

Play proceeds in a similar fashion as before, except that the player should have some understanding about the unknown character trait and thus be better equipped to predict the correct answers. Should the game be published in for example a weekly newspaper column, a suitable format would be for a single situation to appear in each edition with the player or players keeping a cumulative record of their score or by simply retaining the previous newspaper issues. The method of scoring could take a number of forms. For example, where the player is asked to supply the two most appropriate and two least appropriate reactions to the hypothetical circumstance, one point could be awarded for each correct response. Thus, possible scores would vary from 0 to 4 for each situation. Where determining an unknown character trait is a feature of the game and scoring occurs in this fashion, it is contemplated that at least two hypothetical situations would need to be presented to give the player or players at least one opportunity to ascertain the unknown character trait before predicting the correct responses. However, in a further variation, the game could be based on a single round format involving only one hypothetical circumstance where the player or players are given some type of game credit for correctly guessing the unknown character trait after comparison of their responses with the answers provided in the answer list.

The use of point scoring provides a rating for measuring a player's performance. If there is only one player, a further performance rating could be provided which assesses the player's skill based upon the point total. For example, assuming the game is limited to three rounds involving the assessment of three hypothetical situations and scoring proceeds as just described with no separate game credit given for correctly guessing the unknown character trait, the possible point total would vary in a range from 0 to 12 points. A representative "skill level" rating could be provided as follows:

SKILL LEVEL

0–2: poor; 3–5: fair; 6–8: average; 9–10: very good; 11–12 superior

If two or more players wish to play the game competitively, the game could proceed until one player obtains a predetermined number of points, say for example 15 points. Alternatively, the winner could be declared based upon who has the highest number of points after a fixed number of rounds.

A further, more simplified version of the game described above dispenses with the unknown character trait. Play otherwise proceeds in the same fashion as in any of the variations of the game already described. In its most basic variant, the more simplified version involves one hypothetical person confronted with one hypothetical circumstance or situation. Since all of the necessary character traits to correctly assess the situation reactions are disclosed, the player or players have a fair opportunity to predict the responses set forth in the answer list. In this version, the basis for the answers in the answer listing can also be set forth as there is no need to withhold such information in order to permit the player or players to guess an undisclosed character trait.

A representative sample of the more simplified version of the subject game using only disclosed character traits is as follows:

JOAN'S CHARACTER PROFILE

Joan is 12 years old, rather pretty, independent, self-reliant, a little selfish, uninhibited and loves her mother.

SITUATION

Joan and her mother are in the kitchen when her stepfather comes home from the office. Mr. Stevens kisses his wife of four weeks and hands Joan an unexpected gift as he says, "Joan, we are getting along quite well. You can call me dad." How would Joan react? Read Joan's character profile carefully before selecting the two most likely and two least likely reactions for each.

POSSIBLE REACTIONS OF JOAN

1. Smiles and says, "OK".
2. Angrily pushes the gift away.
3. Feels embarrassed.
4. Hesitantly accepts the gift and says, "Not yet."
5. Looks at her mother accusingly.
6. Turns and runs from the room.
7. Feels sad.
8. Ignores her stepfather.
9. Says "Maybe we get along but you can't take dad's place." 10. Feels insulted.

ANSWERS: Most likely 9 and 4; Least likely 1, 2 or 5. Joan is independent, self-reliant and a little selfish so her first reaction is to show disapproval. Although she wants the gift, she may never call Mr. Stevens "Dad". Being selfish and possibly a little greedy, she would not angrily reject the gift. She is definitely not prepared to begin using "Dad" so a smile of approval is unlikely.

It should be noted that in order to make the performance ratings reasonably accurate for a given circumstance, it is desirable to assign a number of character traits to the hypothetical person. This provides the expert or experts with a good basis to judge the appropriateness of the hypothetical person's reaction to a given circumstance and therefore obtain a reasonably accurate set of answers and explanation in the answer list.

The game may be played by any number of individual players including only one player playing the game by himself. Also, teams of players may be selected to compete against another team.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of playing a psychology game, wherein said method comprising the steps of:

(1) providing to a player a description of a hypothetical person having a plurality of disclosed character traits;

(2) providing the player a description of a circumstance with which the hypothetical person is confronted;

(3) providing the player a plurality of descriptions of possible reactions of the hypothetical person to the circumstance:

(4) having the player select as most appropriate at least one of the plurality of descriptions of possible reactions to the selected circumstance; and (5) determining the accuracy of the player's reaction selection in the reaction selection step by comparing the player's reaction selection to an answer list rating said plurality of descriptions of possible reactions based upon the likelihood of the particular response being made by the hypothetical person to the circumstance; wherein the answer list includes a listing of the most likely and the least likely possible reactions to the circumstance and step (4) includes having the player select as least appropriate at least one of the plurality of description of possible reactions to the selected circumstance.

2. The method of claim 1 and further comprising the step of:

(6) rewarding the player with a performance rating which is a game benefit in proportion to the accuracy of the player's reaction selection determined in the determining step (5).

3. A method of playing a psychology game, wherein said method comprising the steps of:

(1) providing to a player a description of a hypothetical person having a plurality of disclosed character traits:

(2) providing a player a description of a circumstance with which the hypothetical person is confronted;

(3) providing the player a plurality of descriptions of possible reactions of the hypothetical person to the circumstance;

(4) having the player select as most appropriate at least one of the plurality of descriptions of possible reactions to the selected circumstance; and (5) determining the accuracy of the player's reaction selection in the reaction selection step by comparing the player's reaction selection to an answer list rating said plurality of descriptions of possible reactions based upon the likelihood of the particular response being made by the hypothetical person to the circumstance; wherein the answer list includes a listing of at least the two most likely possible reactions to the circumstance and step (4) includes having the player select as most appropriate at least two f the plurality of description of possible reactions to the selected circumstance.

4. A method of playing a psychology game, wherein said method comprising the steps of:

(1) providing to a player a description of a hypothetical person having a plurality of disclosed character traits;

(2) providing the player a description of a circumstance with which the hypothetical person is confronted;

(3) providing the player a plurality of descriptions of possible reactions of the hypothetical person to the circumstance;

(4) having the player select as most appropriate at least one of the plurality of descriptions of possible reactions to the selected circumstance; and (5) determining the accuracy of the player's reaction selection in the reaction selection step by comparing the player's reaction selection to an answer list rating said plurality of descriptions of possible reactions based upon the likelihood of the particular response being made by the hypothetical person to the circumstance; wherein the answer list includes a listing of at least the two most likely and the two least likely possible reactions to the circumstance and step (4) includes having the player select at least the two most likely and the two least likely possible reactions to the selected circumstance.

5. A method of playing a psychology game, wherein said method comprising the steps of:

(1) providing to a player a description of a hypothetical person having a plurality of disclosed character traits;

(2) providing the player a description of a circumstance with which the hypothetical person is confronted;

(3) providing the player a plurality of descriptions of possible reactions of the hypothetical person to the circumstance;

(4) having the player select as most appropriate at least one of the plurality of descriptions of possible reactions to the selected circumstance; and (5) determining the accuracy of the player's reaction selection in the reaction selection step by comparing the player's reaction selection to an answer list rating said plurality of descriptions of possible reactions based upon the likelihood of the particular response being made by the hypothetical person to the circumstance; wherein the answer list includes a listing of the plurality of possible reactions according to their relative order of likelihood and step (4) includes having the player determine the relative order of likelihood of the plurality of possible reactions.

6. A method of playing a psychology game with one or more players wherein, said method comprising the steps of:

(1) providing to the player a hypothetical person having a plurality of disclosed character traits and at least one undisclosed character trait. a description of a circumstance with which the hypothetical person is confronted. and a plurality of descriptions of possible reactions of the hypothetical person to the circumstance;

(2) selecting as most appropriate one of the plurality of descriptions of possible reactions to the selected circumstance;

(3) determining the accuracy of the player's reaction selection in the reaction selection step;

(4) rewarding the one or more player's with a performance rating which is a game benefit in proportion to the accuracy of the player's reaction selection determined in the accuracy determining step; and (5) determining the at least one undisclosed character trait by comparing the player's selected circumstances and reaction selection to the circumstances to the respective performance ratings awarded to the player, whereby the determination of the at least one undisclosed character trait of the hypothetical person increases a player's ability to determine the most appropriate selection in the reaction selection step.

7. The method of claim 6 wherein step (2) includes having the player select as least appropriate at least one of the plurality of descriptions of possible reactions to the selected circumstance.

8. The method of claim 6 wherein step (2) includes having the player select as most appropriate at least two of the plurality of descriptions of possible reactions to the selected circumstance.

9. The method of claim 6 wherein step (2) includes having the player select at least the two most likely and the two least likely possible reactions to the selected circumstance.

* * * * *

UNITED STATES PATENT AND TRADEMARK OFFICE

CERTIFICATE OF CORRECTION

PATENT NO. : 5,112,064

DATED : May 12, 1992

INVENTOR(S) : Gail H. Weedman

It is certified that error appears in the above-identified patent and that said Letters Patent is hereby corrected as shown below:

In Column 2, at Line 25, "Principles" should read --principles--

In Column 6, at Line 30, the first "a" should read --the--

In Column 6, at Line 48, "f" should read --of--

Signed and Sealed this

Thirty-first Day of August, 1993

Bruce Lehman

*Attest:*

BRUCE LEHMAN

*Attesting Officer*

*Commissioner of Patents and Trademarks*